US009269252B2

(12) United States Patent
Mroszczak et al.

(10) Patent No.: US 9,269,252 B2
(45) Date of Patent: Feb. 23, 2016

(54) MAN DOWN DETECTOR

(71) Applicant: Honeywell International Inc., Morristown, NJ (US)

(72) Inventors: Stephen J. Mroszczak, Calgary (CA); Walter Thorson, Calgary (CA); Kelly Englot, Calgary (CA)

(73) Assignee: Honeywell International Inc., Morris Plains, NJ (US)

( * ) Notice: Subject to any disclaimer, the term of this patent is extended or adjusted under 35 U.S.C. 154(b) by 2 days.

(21) Appl. No.: 14/255,370

(22) Filed: Apr. 17, 2014

(65) Prior Publication Data

US 2015/0302719 A1 Oct. 22, 2015

(51) Int. Cl.
*G08B 1/08* (2006.01)
*G08B 21/04* (2006.01)

(52) U.S. Cl.
CPC ..... *G08B 21/0446* (2013.01); *G08B 21/0469* (2013.01)

(58) Field of Classification Search
USPC ..... 340/539.1, 539.11, 539.12, 539.13
See application file for complete search history.

(56) References Cited

U.S. PATENT DOCUMENTS

2012/0194334 A1* 8/2012 Worthington et al. ..... 340/521

* cited by examiner

*Primary Examiner* — Daryl Pope
(74) *Attorney, Agent, or Firm* — Conley Rose, P.C.; Kristin Jordan Harkins

(57) ABSTRACT

A man down indicator includes a gas detector which includes a motion sensor. A separate wearable element also includes a motion sensor. The element is wirelessly coupled to, and paired with, the detector. In responsive to a lack of sensed motion at both detector and the element, a pre-alarm condition is initiated for a predetermined period of time by circuitry carried by one of the detector, or the element. Unless interrupted, when the pre-alarm condition terminates, a man down alarm is generated.

20 Claims, 1 Drawing Sheet

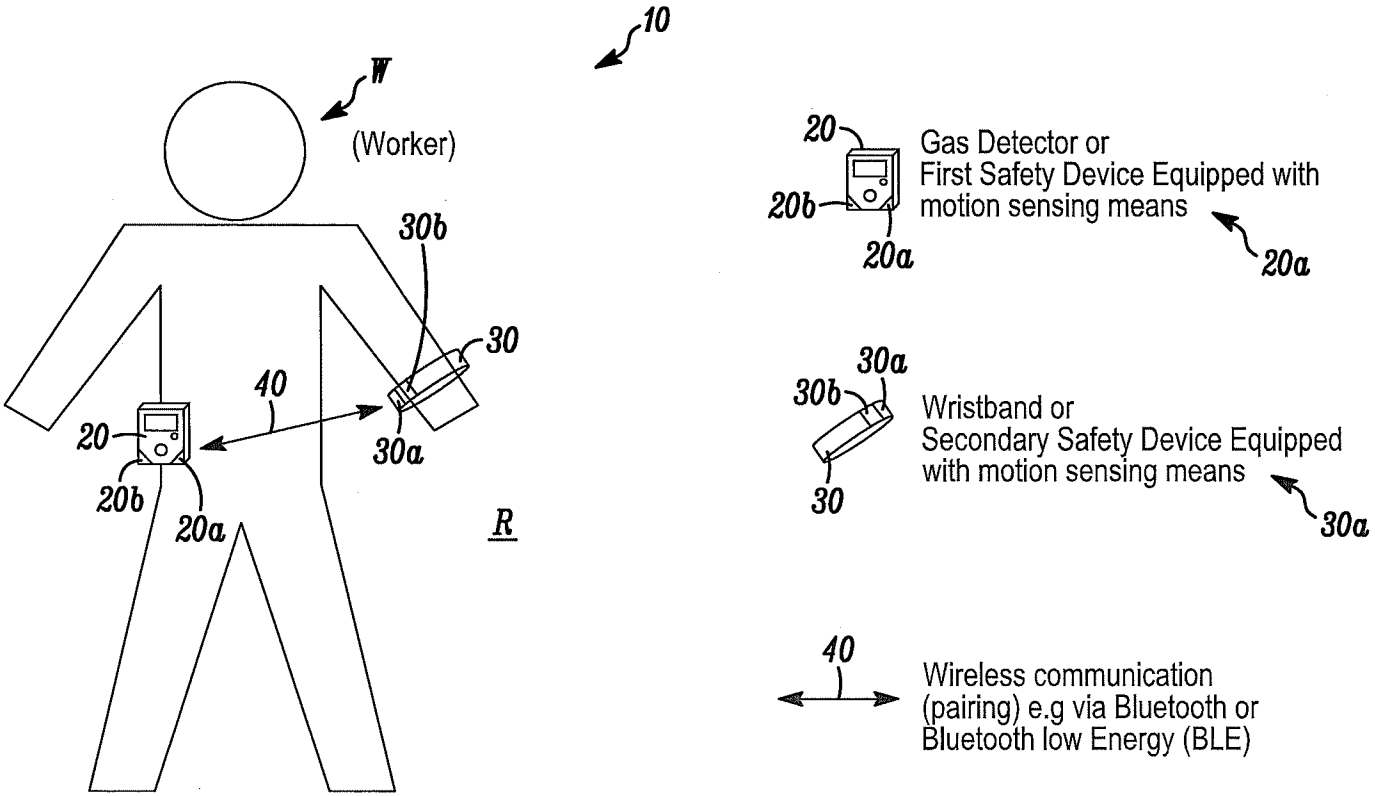
10
W
(Worker)
30b
30
30a
R
40
20
20b
20a
Gas Detector or
First Safety Device Equipped with
motion sensing means
20a
20
20b
20a
Wristband or
Secondary Safety Device Equipped
with motion sensing means
30a
30a
30b
30
40
Wireless communication
(pairing) e.g via Bluetooth or
Bluetooth low Energy (BLE)

MAN DOWN DETECTOR

FIELD

The application pertains to detectors indicative of an incapacitated or unconscious worker. More particularly, it pertains to systems and methods to detect the presence or absence of movement of an individual being monitored.

BACKGROUND

Current man-down detection is accomplished by tracking a worker's movements over a period of time and determining whether sufficient motion has occurred to infer that the worker has not become incapacitated. The worker's movements are measured using an accelerometer or other motion measuring means carried within a first safety device that is carried by the worker or attached to their clothing.

For example, the motion measuring means could be a 3 axis accelerometer carried within a first safety device (such as a portable gas detector) attached to the worker's belt or clothing. The accelerometer triggers when an adjustable amount of time passes without any movement. The detector starts to emit an audio warning to give the user time to disarm the alarm. If the user does not disarm the alarm in time, the device then goes into its alarm mode and reports the error to a monitoring site.

Known solutions suffer from various drawbacks. For example, under general use, the device may register no movement even when there is no emergency. This causes the user to frequently disarm the countdown and becomes a nuisance. In addition, in the course of a day, the user may go on a break and leave the detector in a locker, car seat, table, etc. causing the detector to go into alarm. It is not usual procedure to require that the detector be turned off when not in use, as the expectation is that a detector can last at least a complete shift. It would be desirable to reduce false positive man down alarms.

BRIEF DESCRIPTION OF THE DRAWINGS

FIG. 1 is an exploded view illustrating aspects of a system in accordance herewith.

DETAILED DESCRIPTION

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

In embodiments hereof, the man down detection capability can be improved by having the worker wear a second device which is communicatively coupled with a first safety device using a low power wireless link. The second device is also intended to be worn or carried by the worker, independent of the first safety device. In a preferred embodiment, the first device can include a portable gas detector incorporating a motion measuring means.

The second device can be implemented as an electronic wristband or bracelet worn by the worker. Communication circuitry can implement a low power wireless link between the two devices. For example, Blue Tooth-type low power wireless communications circuitry can provide pairing between the devices. The presence of the two devices can advantageously reduce false positive man down alarms.

When the first device is in close proximity to the second device, it is possible to 'pair' the two devices together using the low power wireless link. Successful device pairing requires the two devices to be in close enough physical proximity to one another that a low power wireless communications link can successfully be established between them.

If it is assumed that the second device (e.g. the wristband) is generally likely to be worn on the worker's body, it is therefore reasonable to infer that detection of a paired state of the wireless communications link can be used as a means of determining whether the worker is also currently carrying the first safety device (i.e. the gas detector). If the first safety device is not in a paired communications state with the second device, this state information can be used to disable the man-down alarm function within the gas detector. In this way, it is possible to greatly reduce the potential for false-positive detection of man-down events when the worker is not actually wearing their gas detector.

In another aspect, the second device, which could be implemented as a wristband, can also be equipped with its own motion sensor such as an accelerometer. In this embodiment, the man-down alarm can only be triggered when a lack of motion is measured independently in both the gas detector and the wristband. The wristband motion sensor would monitor the worker's movements independent of the motion sensing means in the gas detector. For a man down pre-alarm countdown to be triggered, both motion sensors would have to indicate a lack of motion of the wearer.

In another aspect, the wristband can be used as a vehicle for user interaction with the man-down detection capability in the gas detector. Existing man-down detection schemes employ a pre-alarm countdown during which the worker is alerted that insufficient motion has been detected by the device, and that a man down alarm condition will be generated upon expiry of the pre-alarm countdown time period. In this situation, the worker is prompted to cancel the pending alarm by pressing a button on the gas detector prior to expiry of the pre-alarm countdown, thereby indicating they are OK. With the addition of a second motion detector in the wristband, the worker could cancel the alarm simply by shaking their wrist. The shaking motion would be sensed by the wristband, and this detected motion could be used as an indication that the pending alarm can be cancelled.

In yet another aspect, in accordance herewith, a second motion detecting device can be coupled to the user's body. This may be accelerometer or gyroscopic-based and possibly in the form of a small band or pendant that is worn on a wrist or ankle. This device would detect motion in a method similar to that of the gas detector and communicate with the gas detector by a short range wireless link.

A man-down event would require both the gas detector and the secondary device to register no movement. The assumption is that it is unlikely that both devices would stop moving except in an actual man-down scenario. Also, the requirement of both devices to register an event solves the problem of the false alarms when detectors are separated from their owners. The short-range link will be tuned to work just within the "Personal Area Network" of the user, such that if the user takes the detector off and moves a short distance away, the man-down alarm function will be disarmed. When the secondary device is back in range, the alarm will re-arm itself.

FIG. 1 illustrates a configuration 10 in accordance herewith. Without limitation, the system 10 of FIG. 1 can implement the above described processes. A worker W is located in a region R where one or more gases may present a safety issue.

A man down indicating apparatus includes a wearable gas detector 20. Detector 20, a first device, can be implemented to sense a variety of gases without limitation. Detector 20 can also include a motion sensor 20*a* and wireless low power communication circuitry 20*b*. Device 20 need not include a gas sensor and can be implemented in a variety of configurations including those having belt clips, or other forms of attachment to the worker W, without limitation.

A second device 30, which in the exemplary embodiment of FIG. 1 could be implemented as a wrist or leg band, can in one embodiment, include a motion sensor 30*a*, and wireless low power communication circuitry 30*b*. Device 30 can be implemented in a variety of configurations including those having belt clips, or other forms of attachment to the worker W, without limitation.

In accordance herewith the devices 20, 30 function independently of one another though they communicate wirelessly and can function in a paired mode, indicated generally at 40. The paired mode 40 provides information as to the distance between the devices 20, 30. One type of communication elements 20*b*, 30*b* includes Blue Tooth-type low power communications circuitry. Other types of limited range communications equipment come within the spirit and scope hereof.

In summary in accordance herewith, aspects of pairing, independent motion sensing and use of motion detected by either accelerometer as a way of clearing a pre-alarm countdown state provide reductions in false positives, and make it possible to easily cancel pending alarms.

In other embodiments, man-down detection does not have to be implemented in a gas detector, but could be implemented in a single-purpose device for fall detection (as in a pendant worn by elderly people living alone). The second motion sensing device does not have to be carried in a wristband or bracelet. For example, the device could be embodied in a pair of safety glasses, a dog tag or pendant, a watch, or any other suitable embodiment easily worn or carried by the worker.

Advantageously, where the two devices are physically separate and also independent of each other in terms of their motion sensing capabilities, the act of pairing the devices wirelessly makes it possible to use the paired state to infer that the worker is actually carrying both devices. This logic is not always infallible, but is much more robust than methods employing only a single motion sensing device and provides reduced potential for false positive man-down alarms.

Another implementation of the wireless coupling between the two devices, can employ a third intermediary device which acts as a wireless hub connecting both motion sensing devices. For example, the worker could carry a gas detector with motion sensing, the wristband as previously described, as well as an industrial smart phone. Instead of pairing directly between the wrist band and the gas detector, both the gas detector and the wristband could be independently paired to the smartphone. In this embodiment, we are still able to logically associate the data from the various devices, even though the devices are connected by virtue of an intermediate hub (the smart phone). The smartphone itself could employ some of the decision making logic for the man-down alarm. Alternately, this logic could be located in a computer located in the cloud but connected via the smartphone.

In yet other embodiments, the first device can communicate with a displaced monitoring system or location. Irrespective of the function of device one, the use of a second independent device enables more reliable ancillary determinations, such as making man down determinations.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be added to or removed from the described embodiments.

The invention claimed is:

1. A safety detection system comprising:

a first device coupled to a user, wherein the first device comprises a first motion sensor and first communication circuitry;

a second device coupled to the user, wherein the second device comprises a second motion sensor and second communication circuitry, wherein the first communication circuitry and the second communication circuitry are configured to wirelessly pair the first device and the second device; and alarm circuitry configured to: generate a man-down alarm when both the first motion sensor and the second motion sensor detect an absence of motion and the first communication circuitry and the second communication circuitry are wirelessly paired.

2. The safety detection system of claim 1, wherein the alarm circuitry is further configured to:

disable a generation of the man-down alarm when the first communication circuitry and the second communication circuitry are not wirelessly paired.

3. The safety detection system of claim 2, where the first device comprises a gas detector.

4. The safety detection system of claim 3, wherein the second device comprises a structure for attaching the second device to the user.

5. The safety detection system of claim 4, wherein the first device comprises a structure for attaching the gas detector to the user.

6. The safety detection system of claim 1, wherein the alarm circuitry is further configured to: initiate a pre-alarm countdown when both the first notion sensor and the second motion sensor detect the absence of motion and the first communication circuitry and the second communication circuitry are wirelessly paired, wherein the circuitry generates the man-down alarm at the end of the pre-alarm countdown, and wherein the circuitry is further configured to: terminate the pre-alarm countdown in response to the detection of motion by either the first motion sensor or the second motion sensor.

7. A safety system comprising:

an ambient condition detector comprising a first motion sensor;

a separate element comprising a second motion sensor; and alarm circuitry disposed in the ambient condition detector, the separate element, or both, wherein the alarm circuitry is configured to:

wirelessly pair the ambient condition detector and the separate element;

responsive to a lack of sensed motion at both the ambient condition detector and the separate element, initiate a pre-alarm condition for a predetermined period of time; and unless interrupted by a motion detected by the first motion sensor or the second motion sensor, generate an alarm when the pre-alarm condition terminates.

8. The safety system of claim 7 where the ambient condition detector is selected from a class which includes at least gas detectors, fire detectors, smoke detectors, or humidity detectors.

9. The safety system of claim 7, further comprising communication circuitry configured to transmit the alarm to a displaced monitoring location.

10. A detection method comprising:

monitoring a first device for a presence of motion, wherein the first device comprises a first motion sensor, and wherein the first device is coupled to a user;

monitoring a second device for the presence of motion, wherein the second device comprises a second motion sensor, wherein the second device is coupled to the user, and wherein the first device and the second device are wirelessly paired;

detecting an absence of motion at the first device using the first motion sensor;

detecting the absence of motion at the second device using the second motion sensor; and generating an alarm in response to both the absence of motion at the first device and the absence of motion at the second device.

11. The method of claim 10, further comprising attaching the first device and the second device to the user being monitored.

12. The method of claim 11, further comprising:

initiating a pre-alarm condition in response to the both the absence of motion at the first device and the absence of motion at the second device, wherein generating the alarm occurs when the pre-alarm condition terminates.

13. The method of claim 12, further comprising:

detecting motion at the first device or the second device after initiating the pre-alarm condition; and terminating the pre-alarm condition in response to detecting the motion.

14. The method of claim 10, further comprising:

detecting that the first device and the second device are no longer wirelessly paired; and disabling the generation of the alarm in response to detecting that the first device and the second device are no longer wirelessly paired.

15. The method of claim 14, further comprising;

detecting that the first device and the second device are within a pairing distance after detecting that the first device and the second device are no longer wirelessly paired;

wirelessly pairing the first device and the second device in response to detecting that the first device and the second device are within the pairing distance; and re-enabling the generation of the alarm.

16. The method of claim 10, further comprising:

detecting motion at the first device or the second device after generating the alarm; and terminating the alarm in response to detecting the motion.

17. The method of claim 10, where the first device and the second device are wirelessly paired over a short-range link.

18. The method of claim 17, wherein the short-range link comprises a link using a BlueTooth communication protocol.

19. The method of claim 10, wherein the first device comprises a band or pendent disposed about a user's wrist or ankle.

20. The method of claim 10, wherein the first motion sensor or the second motion sensor comprises at least one of an accelerometer or a gyroscope.

* * * * *